US011687023B2

(12) United States Patent
Horie et al.

(10) Patent No.: US 11,687,023 B2
(45) Date of Patent: Jun. 27, 2023

(54) IMAGING SYSTEM WITH GLOSS TREATMENT DEVICE

(71) Applicant: HEWLETT-PACKARD DEVELOPMENT COMPANY, L.P., Spring, TX (US)

(72) Inventors: Takayuki Horie, Kanagawa (JP); Tatsunori Izawa, Kanagawa (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/642,318

(22) PCT Filed: Sep. 4, 2020

(86) PCT No.: PCT/US2020/049347
§ 371 (c)(1),
(2) Date: Mar. 11, 2022

(87) PCT Pub. No.: WO2021/066999
PCT Pub. Date: Apr. 8, 2021

(65) Prior Publication Data

US 2022/0334526 A1 Oct. 20, 2022

(30) Foreign Application Priority Data

Oct. 4, 2019 (JP) ..... 2019-183845

(51) Int. Cl.

| | |
|---|---|
| ***G03G 15/20*** | (2006.01) |
| ***G03G 15/00*** | (2006.01) |
| ***G03G 9/087*** | (2006.01) |
| ***G03G 9/09*** | (2006.01) |

(52) U.S. Cl.
CPC ..... *G03G 15/6585* (2013.01); *G03G 9/08782* (2013.01); *G03G 9/0926* (2013.01)

(58) Field of Classification Search
CPC ..... G03G 9/08782; G03G 9/0926; G03G 15/6585
See application file for complete search history.

(56) References Cited

U.S. PATENT DOCUMENTS

| | | | | |
|---|---|---|---|---|
| 6,535,712 | B2 | 3/2003 | Richards | |
| 7,769,336 | B2 | 8/2010 | Ishizuka | |
| 8,472,820 | B2 | 6/2013 | Matsumoto | |
| 8,475,991 | B2 * | 7/2013 | Fujita | G03G 15/08 430/124.3 |

(Continued)

FOREIGN PATENT DOCUMENTS

| | | | |
|---|---|---|---|
| JP | 2002-341619 | A | 11/2002 |
| JP | 2006-11218 | A | 1/2006 |

(Continued)

*Primary Examiner* — Hoang X Ngo
(74) *Attorney, Agent, or Firm* — Foley & Lardner LLP

(57) ABSTRACT

An imaging system includes a toner image forming device and a gloss treatment device. The toner image forming device accommodates a color toner that forms a color toner image on a printing medium, and which accommodates a clear toner that forms a clear toner image on the printing medium. The clear toner has a wax content that is lower than a wax content of the color toner. The gloss treatment device melts the clear toner on the printing medium to apply gloss treatment to the printing medium including the color toner image and the clear toner image.

15 Claims, 13 Drawing Sheets

(56) References Cited

U.S. PATENT DOCUMENTS

| | | | | |
|---|---|---|---|---|
| 8,634,753 | B2 | 1/2014 | Omata | |
| 9,482,993 | B2 | 11/2016 | Yagi | |
| 2002/0167681 | A1* | 11/2002 | Ide | G03G 15/6585 358/1.9 |

FOREIGN PATENT DOCUMENTS

| | | | |
|---|---|---|---|
| JP | 2013-142893 | A | 7/2013 |
| JP | 2014-81520 | A | 5/2014 |
| JP | 2017-68166 | A | 4/2017 |

* cited by examiner

IMAGING SYSTEM WITH GLOSS TREATMENT DEVICE

BACKGROUND

In an imaging system, after forming an image with a color toner and a clear toner, the image may be subjected to gloss treatment by melting the color toner and the clear toner.

DETAILED DESCRIPTION

Hereinafter, an example imaging system will be described with reference to the accompanying drawings. The imaging system may be an image forming apparatus such as a printer according to some examples, or may be a device to be used in an image forming apparatus, such as a developing device or the like according to other examples. In the following description, with reference to the drawings, the same reference numbers are assigned to the same components or to similar components having the same function, and overlapping description is omitted.

Figure 1:
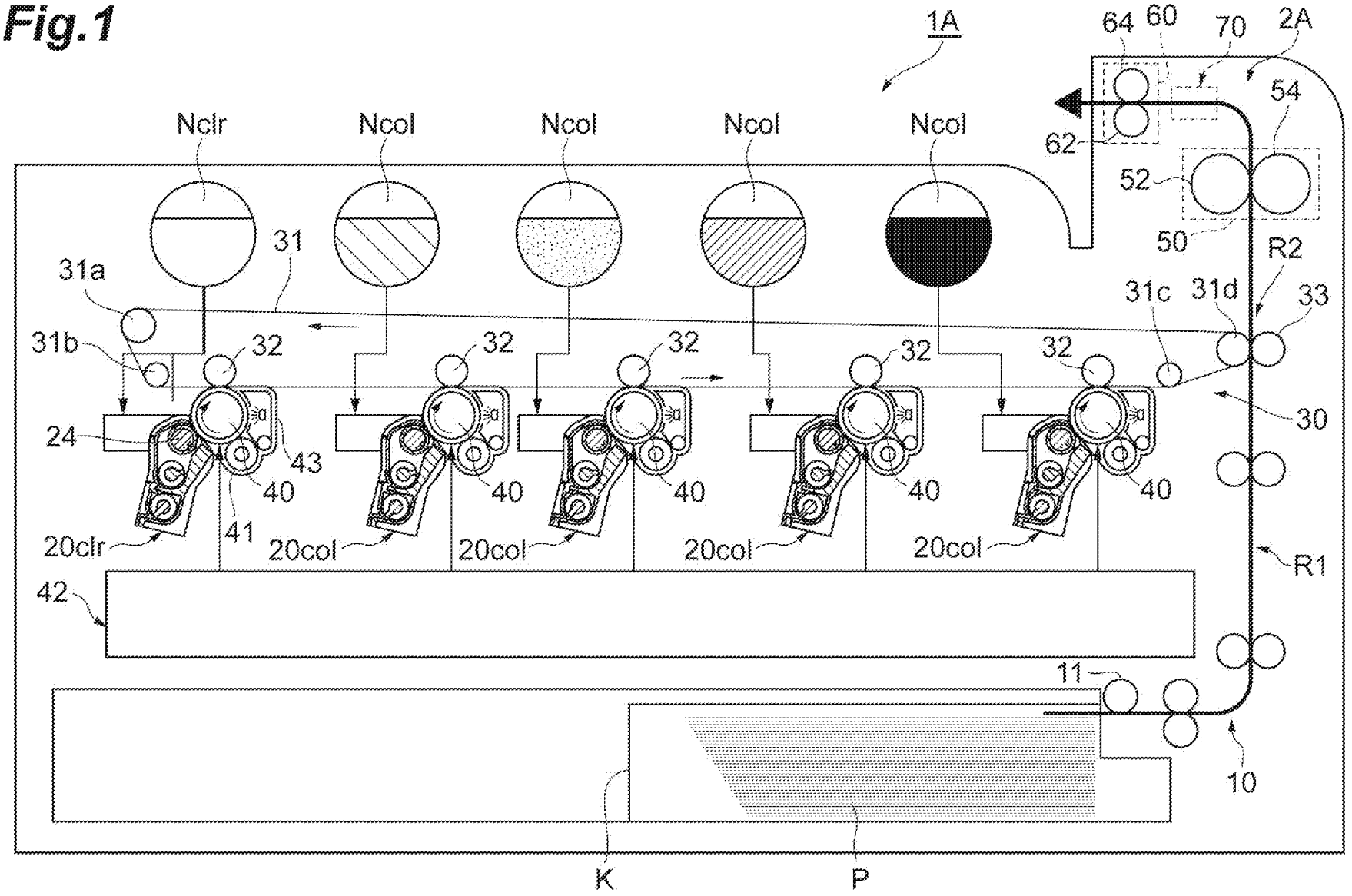
FIG. 1 is a schematic view illustrating an example image forming apparatus.

FIG. 1 is a schematic view illustrating an example image forming apparatus. The example image forming apparatus 1A includes a toner image forming device 2A and a gloss treatment device 70. The toner image forming device 2A is a device that forms a color toner image with a color toner such as magenta, yellow, cyan, and black, and a clear toner image with a clear toner for applying gloss onto a printing medium such as paper P. The color toner and the clear toner may be referred to collectively as "toner". The gloss treatment device 70 may apply gloss treatment to the paper P on which the color toner image and the clear toner image are formed. An application of gloss treatment with respect to the paper P may be referred to as a gloss treatment. The clear toner may be a transparent toner, a semi-transparent toner, and/or a colored toner (e.g., tinted toner). The clear toner is also referred to as a gloss toner, a coating toner or the like. The toner image forming device 2A includes a conveying device 10, a color toner development device 20*col*, a clear toner development device 20*clr*, a transfer device 30, an image carrier 40, a fixing device 50, and an ejection device 60. The conveying device 10 conveys the paper P that is a printing medium. The color toner development device 20*col* is a first development device that develops an electrostatic latent image for a color toner. The clear toner development device 20*clr* is a second development device that develops an electrostatic latent image for a clear toner. The transfer device 30 secondarily transfers the color toner image and the clear toner image to the paper P. The image carrier 40 has a surface (peripheral surface) on which an electrostatic latent image is formed. The fixing device 50 fixes a toner image to the paper P. The ejection device 60 ejects the paper P.

The conveying device 10 conveys the paper P as the printing medium on which an image is to be formed, along a conveying route R1. The paper P is stacked on a cassette K and is accommodated therein, and is picked up by a paper feeding roller 11 to be conveyed. The conveying device 10 causes the paper P to reach a transfer nip region R2 through the conveying route R1 at a timing at which a toner image to be transferred to the paper P reaches the transfer nip region R2.

Four of the color toner development devices 20*col* are provided in correspondence with the color toners. One clear toner development device 20*clr* is provided in correspondence with the clear toner. The clear toner development device 20*clr* is located on an upstream side along a transfer belt 31 in relation to any of the color toner development devices 20*col*. Accordingly, when the clear toner is transferred to the transfer belt 31 for the first time and an image is formed on the paper P, a layer of the clear toner forms an uppermost layer (or a first layer on the transfer belt 31).

Each of the color toner development devices 20*col* and the clear toner development device 20*clr* includes a development roller 24 that transfers the associated toner to the image carrier 40. The color toner development devices 20*col* and the clear toner development device 20*clr*, may use a developer among a one-component development type and a two-component development type. As an example, the two-component developer may include a toner and a carrier. In the color toner development devices 20*col* and the clear toner development device 20*clr*, the amounts of the toner (e.g., toner particles) and of the carrier (e.g., carrier particles) may be adjusted to a targeted mixing ratio, and may be mixed and stirred so as to uniformly disperse the toner and achieve a developer having an optimal charging amount. The color toner development devices 20*col* and the clear toner development device 20*clr* cause the developer to be carried on the development roller 24. When the developer is carried via a rotation of the development roller 24 to a development region of the development roller 24 that faces the image carrier 40, the toner in the developer carried on the development roller 24 is transferred to an electrostatic latent image formed on a peripheral surface of the image carrier 40, so as to develop the electrostatic latent image.

The toner contains wax as a release agent, to promote the peeling-off of the paper P on which a toner image is formed from the transfer belt 31 or the like. The wax may include a vegetable wax such as carbana wax, sugar wax, and wood wax, an animal wax such as beeswax, insect wax, whale wax, and wool wax, and/or a synthetic hydrocarbon-based wax such as a Fischer-Tropsch wax (FT wax) having ester in a side chain, polyethylene wax, and polypropylene wax.

The transfer device 30 secondarily transfers a toner image formed on each of the color toner development devices 20*col* or the clear toner development device 20*clr* to the paper P. The transfer device 30 includes the transfer belt 31, suspension rollers 31*a*, 31 *b*, 31*c*, a primary transfer roller, and a secondary transfer roller 33. The transfer belt 31 transfers the toner images having been primarily transferred from the image carriers 40. The suspension rollers 31*a*, 31*b*, 31*c*, and 31*d* suspend or support the transfer belt 31. The primary transfer roller sandwiches the transfer belt 31 together with the image carrier 40. The secondary transfer roller 33 sandwiches the transfer belt 31 together with the suspension roller 31*d*. The transfer belt 31 may include an endless belt that is circulated by the suspension rollers 31*a*, 31*b*, 31*c*, and 31*d*. The suspension rollers 31*a*, 31 *b*, 31*c*, and 31*d* may rotate around respective axial lines (or rotational axes). The suspension roller 31*d* may be a drive roller that rotates around the axial line thereof, and the suspension rollers 31*a*, 31*b*, and 31*c* may be driven rollers which are driven and rotated by a rotation of the suspension roller (drive roller) 31*d*. A primary transfer roller 32 is provided adjacent each image carrier 40, to press against the image carrier 40 from an inner periphery side of the transfer belt 31. The secondary transfer roller 33 extends parallel to the suspension roller 31*d* with the transfer belt 31 interposed between the secondary transfer roller 33 and the suspension roller 31*d*, and presses against the suspension roller 31*d* from an outer periphery side of the transfer belt 31. Accordingly, the secondary transfer roller 33 forms the transfer nip region R2 between the secondary transfer roller 33 and the transfer belt 31.

The image carrier 40 is also referred to as an electrostatic latent image carrier, a photoreceptor drum, or the like. Five of the image carriers 40 are provided in correspondence with the respective toners. The image carriers 40 are spaced apart along a movement direction of the transfer belt 31. Each of the color toner development devices 20*col* or the clear toner development device 20*clr*, and a charging roller 41, an exposure unit (or exposure device) 42, and a cleaning unit (or cleaning device) 43 are provided around each of the image carriers 40.

The charging roller 41 is a charging device that uniformly charges a surface of the image carrier 40 to a predetermined potential. The charging roller 41 moves in accordance with a rotation of the image carrier 40. The exposure unit 42 exposes the surface of the image carrier 40 charged by the charging roller 41 in correspondence with an image to be formed on the paper P. Accordingly, a potential of a portion of the surface of the image carrier 40 having been exposed to the exposure unit 42 varies, so as to form an electrostatic latent image.

Each of the color toner development devices 20*col* develops the electrostatic latent image formed on the image carrier 40 by using a color toner supplied from a color toner tank Ncol that is a first toner tank facing the color toner development device 20*col*, to generate a color toner image. Color toners of magenta, yellow, cyan, and black are respectively accommodated in the respective color toner tanks Ncol. The clear toner development device 20*clr* develops the electrostatic latent image formed on the image carrier 40 by using a clear toner supplied from a clear toner tank Nclr that is a second toner tank facing the clear toner development device 20*clr*, to generate a clear toner image. The clear toner is accommodated in the clear toner tank Nclr. The clear toner tank Nclr in which the clear toner is accommodated is located upstream of all the color toner tanks Ncol, in the movement direction of the transfer belt 31 toward the transfer nip region R2. The cleaning unit 43 recovers a toner that remains on the image carrier 40 after the toner image formed on the image carrier 40 is primarily transferred to the transfer belt 31.

The fixing device 50 causes the paper P to pass through a fixing nip region in which the paper P is heated and pressed, to attach the toner image which has been secondarily transferred from the transfer belt 31 to the paper P, onto the paper P so as to fix the toner image. The fixing device 50 includes a heating roller 52 that heats the paper P and a pressing roller 54 that presses and rotates the heating roller 52. The heating roller 52 and the pressing roller 54 are formed in a substantially cylindrical shape, and a heat source such as a halogen lamp is provided inside the heating roller 52. The fixing nip region forms a contact region between the heating roller 52 and the pressing roller 54, and the paper P is conveyed to pass through the fixing nip region to melt and fix the toner image to the paper P.

The ejection device 60 includes ejection rollers 62 and 64 which eject the paper P on which the toner image has been fixed by the fixing device 50 and which has been subjected to the gloss treatment by the gloss treatment device 70, to the outside of the apparatus.

Figure 2:
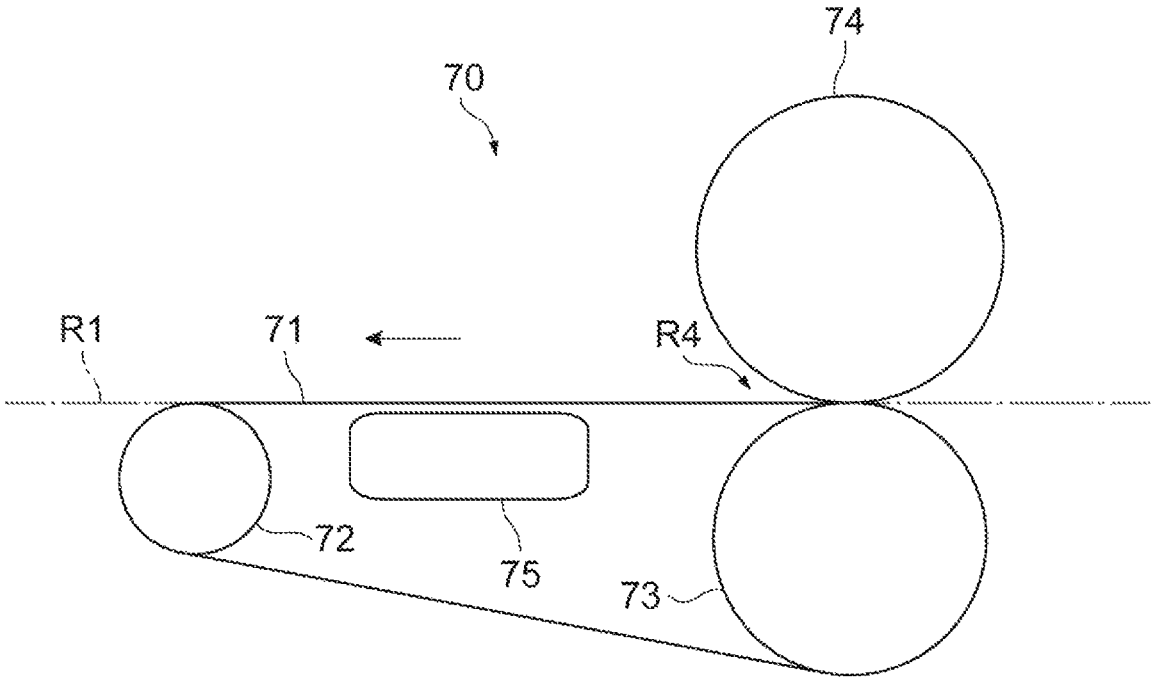
FIG. 2 is a schematic view illustrating an example gloss treatment device.

FIG. 2 is a schematic view illustrating an example gloss treatment device. The example gloss treatment device 70 applies gloss treatment to the paper P on which the toner image has been fixed by the fixing device 50. The gloss treatment device 70 is disposed between the fixing device 50 and the ejection device 60 along a conveying route of the paper P. According to some examples, the gloss treatment device 70 may be mounted to the ejection device 60 or may be provided independently from the image forming apparatus 1A. According to examples, the image forming apparatus 1A has a gloss printing mode and a normal printing mode. In the gloss printing mode, the paper P to which the toner image has been fixed, is conveyed to the gloss treatment device 70. In the normal printing mode, the paper P to which the toner image has been fixed is ejected, without conveying the paper P to the gloss treatment device 70. According to examples, the gloss printing mode and the normal printing mode may be set by a user (via a setting of a user) to switch between the two modes.

According to examples, the gloss treatment device 70 includes a conveying belt 71, a suspension roller 72, a heating roller 73, a pressing roller 74, and a cooling device 75.

The conveying belt 71 may include an endless belt that conveys the paper P along the conveying route R1. The conveying route R1 is a route through which the paper P is conveyed, and passes through an outer peripheral surface of the conveying belt 71. The outer peripheral surface of the conveying belt 71 is set to a smooth surface for smoothing a toner image on the paper P.

The suspension roller 72 engages with the conveying belt 71. The suspension roller 72 may be disposed downstream of the heating roller 73, the pressing roller 74, and the cooling device 75 in a conveying direction of the conveying route R1. Two or more of the suspension rollers 72 may be provided.

The heating roller 73 and the pressing roller 74 constitute a re-melting assembly (or re-melting device) that re-melts the color toners and the clear toner. The heating roller 73 is a roller that engages with the conveying belt 71 and heats the conveying belt 71. The pressing roller 74 is a roller that is disposed on a side opposite to the heating roller 73 with respect to the conveying belt 71, and presses the conveying belt 71 against the heating roller 73. The pressing roller 74 forms a re-melting nip region R4 for re-melting the color toners and the clear toner between the pressing roller 74 and the conveying belt 71 that conveys the paper P. Any one of the suspension roller 72, the heating roller 73, and the pressing roller 74 may be a driven roller or a drive roller.

The cooling device 75 cools down the color toners and the clear toner which are melted on the paper P. The cooling device 75 is disposed in an inner space of the conveying belt 71 and between the heating roller 73 and the suspension roller 72. For example, the cooling device 75 may be a heat sink, a cooling fan, a heat pipe, a Peltier element, or the like. In the gloss treatment device 70, the cooled paper P is separated from the conveying belt 71 (peeling-off process), to be ejected.

An example printing process that may be carried out by the image forming apparatus 1A will be described. When an image signal of an image to be recorded (or printed) is input to the image forming apparatus 1A, a control unit (or controller) of the image forming apparatus 1A causes the paper feeding roller 11 to rotate so as to pick up and convey the paper P stacked in the cassette K. In addition, a surface of the image carrier 40 is uniformly charged to a predetermined potential by the charging roller 41 (charging process). Then, an electrostatic latent image is formed by irradiating the surface of the image carrier 40 with laser light by the exposure unit 42 on the basis of the image signal that is received (exposure process).

In each of the color toner development devices 20*col* and the clear toner development device 20*clr*, an electrostatic latent image is developed and thus a toner image is formed (development process). The toner image formed in this manner is primarily transferred from the image carrier 40 to the transfer belt 31 in a region in which the image carrier 40 faces the transfer belt 31 (transfer process). The toner images formed on the five image carriers 40 are sequentially layered on the transfer belt 31, and a single composite toner image is formed. In addition, the composite toner image is secondarily transferred to the paper P that is conveyed from the conveying device 10 in the transfer nip region R2 in which the suspension roller 31*d* faces the secondary transfer roller 33.

The paper P to which the composite toner image has been secondarily transferred, is conveyed to the fixing device 50. The fixing device 50 heats and presses the paper P between the heating roller 52 and the pressing roller 54 when the paper P passes through the fixing nip region to melt and fix the composite toner image to the paper P (fixing process).

The paper P to which the composite toner image has been fixed, is conveyed to the gloss treatment device 70. In the gloss treatment device 70, the paper P passes through the re-melting nip region R4 between the heating roller 73 and the pressing roller 74, to heat and press the paper P. According to this, the color toners and the clear toner which constitute the color toner images and the clear toner image formed on the paper P are re-melted in a pressed state (re-melting process). In the re-melting process, the toners are re-melted, and thus the melted toner on the paper P come into close contact (or surface contact) with a surface of the conveying belt 71, wherein a surface of the melted toner is substantially entirely in contact with the conveying belt 71, such that the surface of the melted toner adopts the shape of the surface of the conveying belt 71. In addition, the cooling device 75 cools down the conveying belt 71 and the paper P, to cool and solidify the melted toner (cooling process). As the melted toner is cooled and solidified by the cooling process, a surface shape of the conveying belt 71 is transferred to the toner on a surface of the paper P due to the surface contact of the melted toner with the conveying belt 71, and thus the melted toner is flattened (or smoothened). The toner on the paper P is peeled-off from the surface of the conveying belt 71, and the paper P is then ejected to the outside of the image forming apparatus 1A by the ejection rollers 62 and 64.

Figure 3:
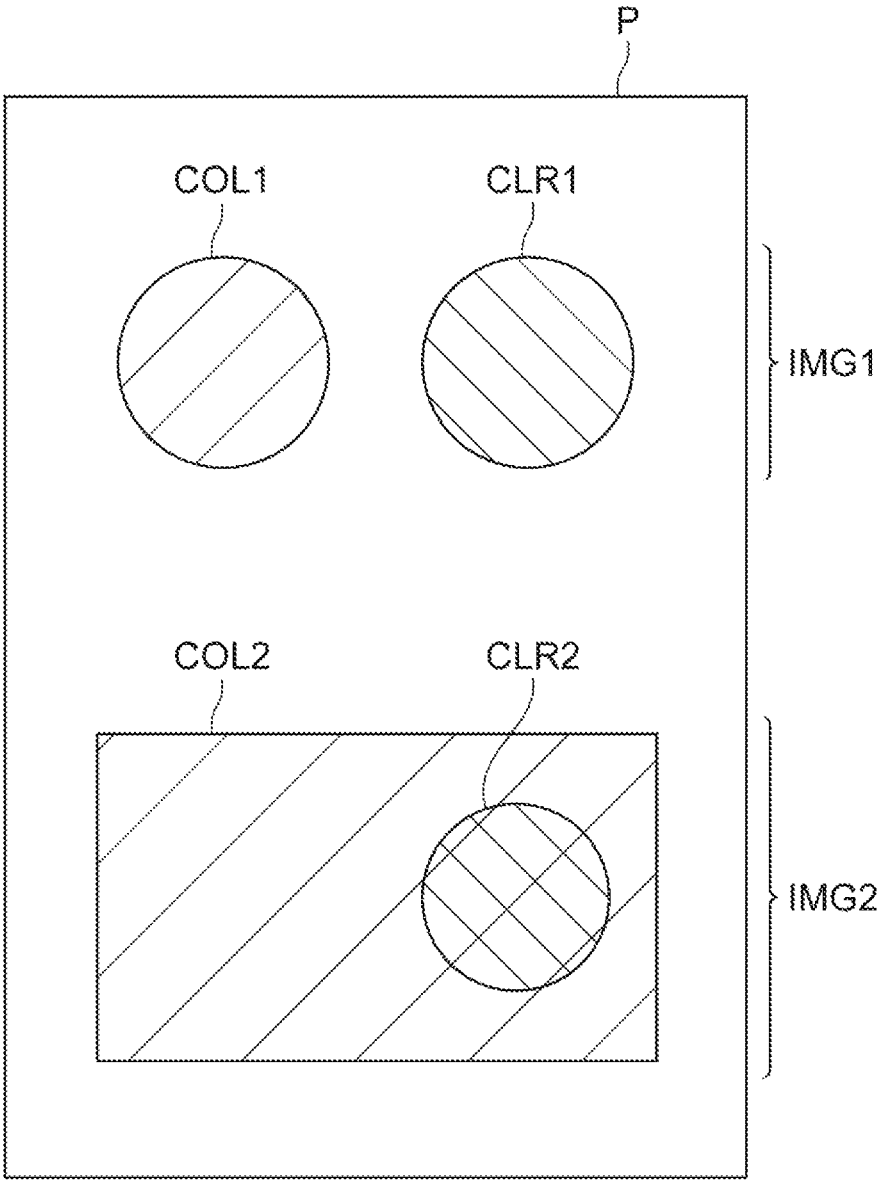
FIG. 3 is a schematic view illustrating a sheet of paper including image regions printed in an example printing process.

In some cases where the color toner images and the clear toner image are formed in different shapes and/or at different regions of the printing medium, the gloss may be applied differently to the clear toner image and to the color toner images. A region in which the clear toner image is formed may be referred to as a clear toner image region, and a region in which the color toner image(s) is or are formed exclusively, without any clear toner, may be referred to as a color-exclusive image region. The clear toner image region may include a clear toner image layered with a color toner image. According to examples, the gloss (glossiness) in the clear toner image region may be intended to be greater than in the color-exclusive image region. In some examples, the color-exclusive image region may be intended to have no glossiness or substantially no glossiness. Accordingly, the gloss (glossiness) of a region in which the clear toner image is formed may be intended to be increased, relative to the gloss (glossiness) of a region in which the color toner images exclusively are formed. In other examples, the region in which the clear toner image is formed may be intended to be glossy, while the region in which the color toner images are formed exclusively, may not be intended to be glossy. For example, with reference to FIG. 3, a first image IMG1 may include a color toner image COL1 and a clear toner image CLR1 formed in different regions on the paper P, and a second image IMG2 may include a clear toner image CLR2 overlapping part of the color toner image COL2 on the paper P. In the image IMG1, the glossiness of the clear toner image CLR1 may be intended to be greater than the glossiness of the color toner image COL1 (or the clear toner image CLR1 may be intended to have gloss while the color toner image COL1 may be intended to have no or substantially no gloss, so as not to look glossy). In the image IMG2, the glossiness of the region in which the color toner image COL2 and the clear toner image CLR2 overlap each other may be intended to be greater than the glossiness of a color-exclusive image region (a region of the color toner image COL2 excluding the region of the clear toner image CLR2), or the clear toner image region CLR2 may be intended to be glossy while the color-exclusive image region may be intended not to be glossy.

In the gloss treatment device 70, the smoothness of the toners increases with the length of time during which the melted toners on the paper P are in close contact (e.g., surface contact) with the surface of the conveying belt 71. Accordingly, the smoothness and gloss increases as the duration of the surface contact between the toner and the conveying belt increases. For example, the earlier the toner on the paper P is peeled off from the surface of the conveying belt 71, the lower the smoothness of the toner is. As a result, the glossiness is lessened.

In the image forming apparatus 1A, the amount of wax contained in the clear toner is set to be less than the amount of wax contained in the color toners to increase the gloss of the region in which the clear toner image is formed (e.g., the clear toner image region) and to lower the gloss of the region in which the color toner images are formed exclusively, without any clear toner (e.g., the color-exclusive image region). For example, the amount of wax contained in the clear toner accommodated in the clear toner tank Nclr is set to be less than the amount of wax contained in the color toners contained in the color toner tanks Ncol. Wax is a release agent, and thus the wax has a peeling-off effect with respect to the conveying belt 71, which may cause the paper and/or toner images to peel off from the conveying belt 71 (e.g., prevent adhesion of the toner image with the conveying belt 71). Accordingly, the ease with which the toner image may peel-off from the conveying belt 71 increases as the amount of wax increases. That is, when the amount of wax contained in the clear toner is set to be less than the amount of wax contained in the color toners, the paper P is likely to peel-off easily from the conveying belt 71 in the region in which the color toner images are formed without any clear toner image, in comparison to the region in which the clear toner image is formed, and thus the gloss becomes lower.

Figure 4:
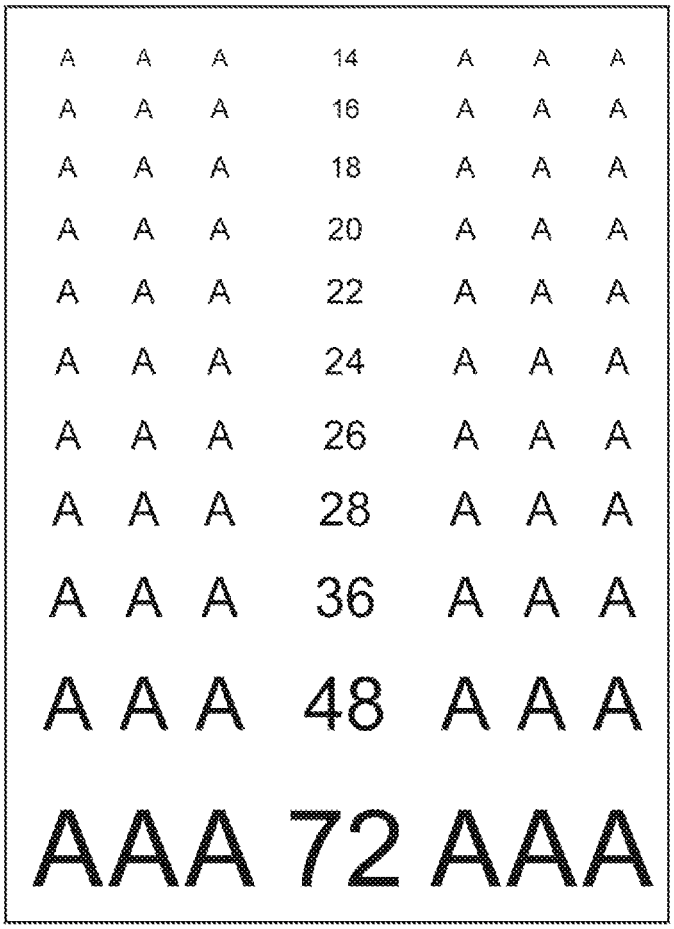
FIG. 4 is a schematic view illustrating an example test chart.

A gloss treatment was carried out to the paper P with an example gloss treatment device by using a test chart illustrated in FIG. 4 after forming the color toner images and the clear toner image on the paper P. The test chart illustrated in FIG. 4 includes printed characters having different font sizes and different font line widths that are aligned in a conveying direction of the paper P. In the gloss treatment device, a conveying speed of the conveying belt is set to 60 mm/sec, and a heating temperature of the heating roller is set to 130° C. In addition, FIGS. 5 and 6 illustrate results of an examination was made on a relationship of a ratio of the amount of wax contained in the clear toner to the amount of wax contained in the color toners, relative to a font size (FIG. 5) and relative to a font line width (FIG. 6) with which gloss generated by the gloss treatment, is visually recognizable or perceivable with the naked eye.

Figure 5:
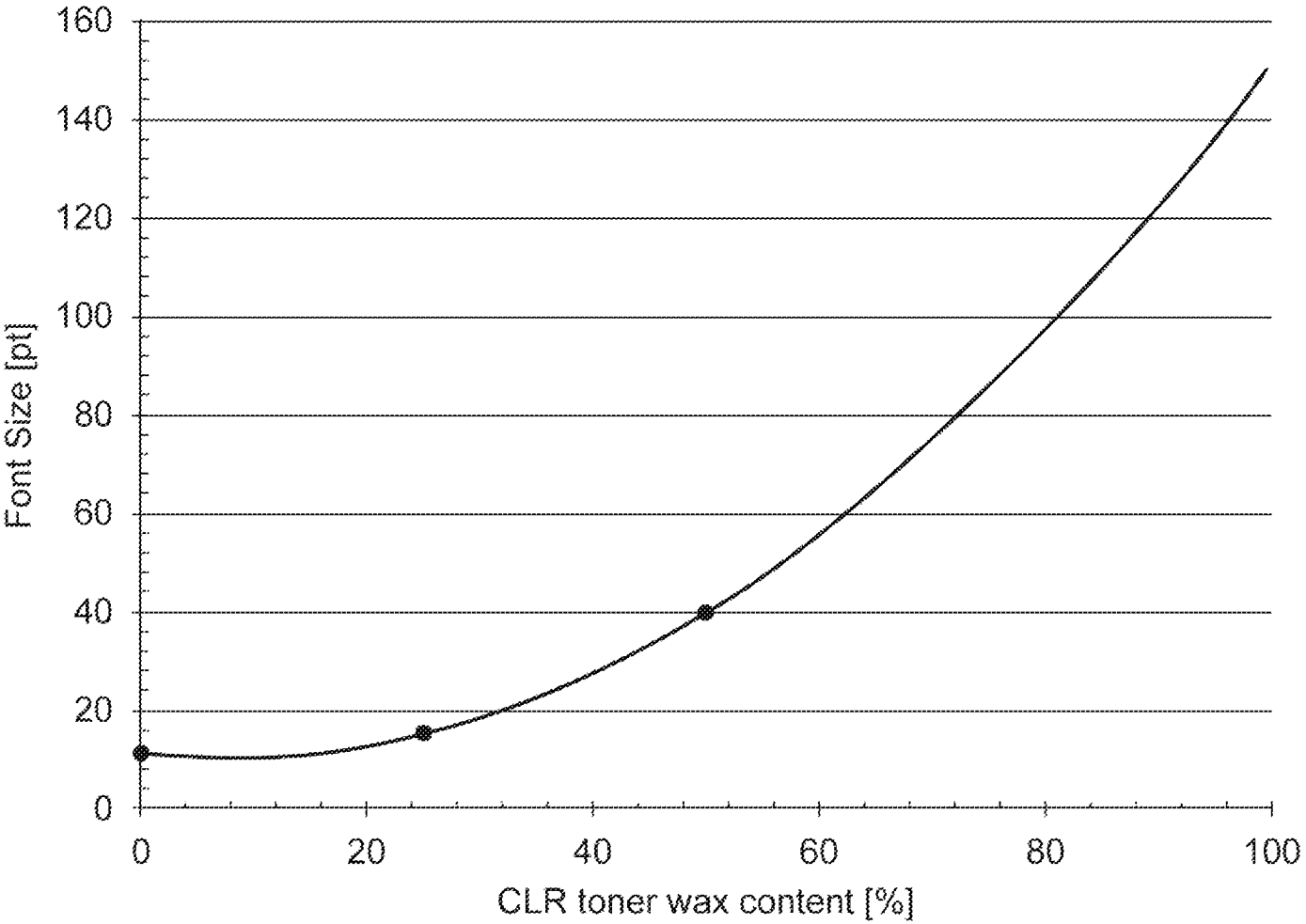
FIG. 5 is a graph showing an example relationship of a wax content relative to a font size that can be visually recognized with the naked eye.

FIG. 5 shows a relationship between the ratio of the amount of wax contained in the clear toner to the amount of wax contained in the color toners, and the font size with which gloss from the gloss treatment, can be visually recognized. In FIG. 5, the horizontal axis represents the ratio [%] of the amount of wax contained in the clear toner to the amount of wax contained in the color toners, and the vertical axis represents the font size [pt] of the test chart. FIG. 6 shows the relationship between the ratio of the amount of wax contained in the clear toner to the amount of wax contained in the color toners, and the font line width with which the gloss produced by the gloss treatment, can be visually recognized. In FIG. 6, the horizontal axis represents the ratio [%] of the amount of wax contained in the clear toner to the amount of wax contained in the color toners, and the vertical axis represents the font line width [mm] of the test chart.

Figure 6:
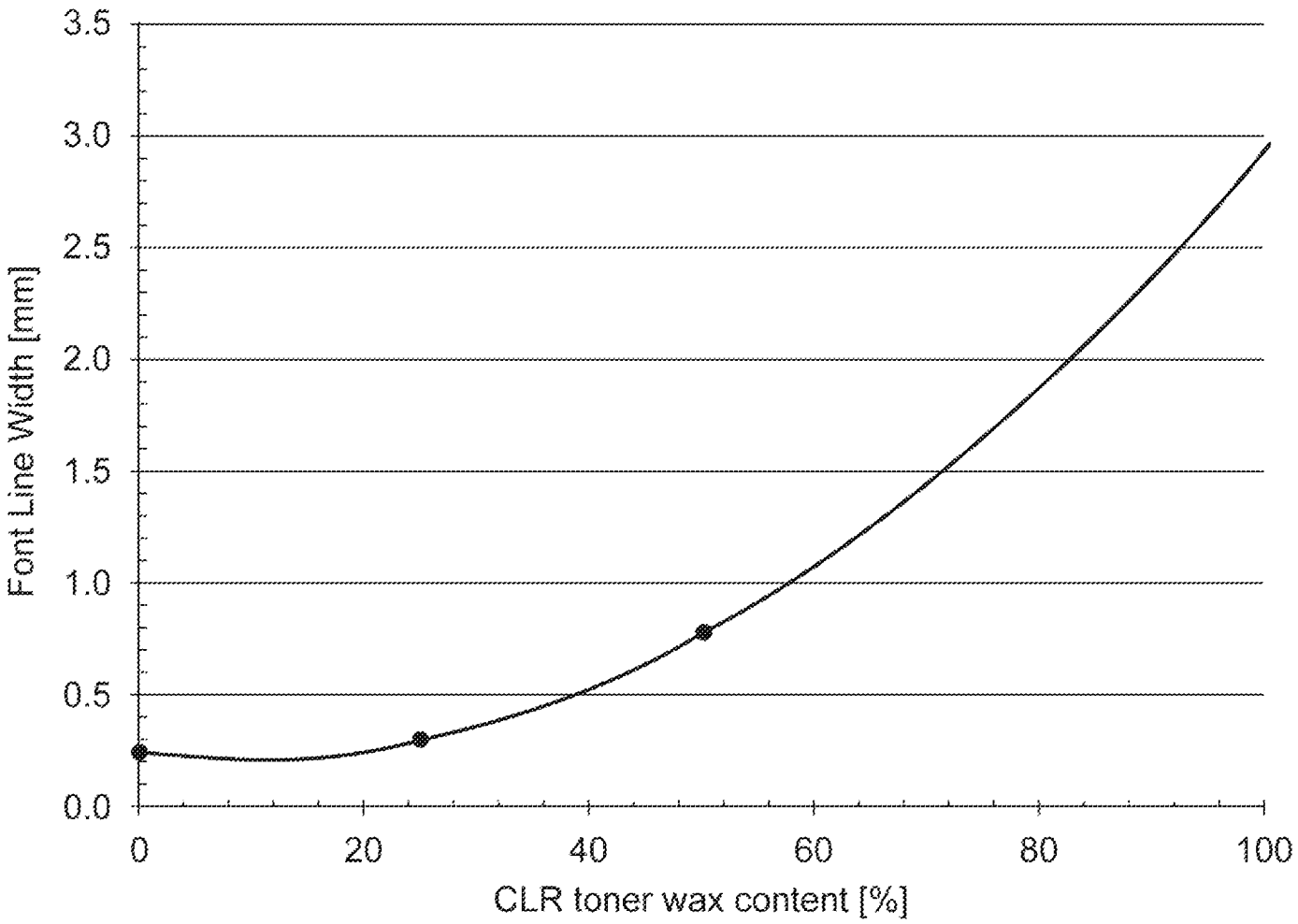
FIG. 6 is a graph showing an example relationship of a wax content relative to a font line width that can be visually recognized with the naked eye.

With reference to FIG. 5 and FIG. 6, when the ratio of the amount of wax contained in the clear toner to the amount of wax contained in the color toners is 25% or less, that is, in a case where the amount of wax contained in the clear toner is 0.25 times or less the amount of wax contained in the color toners, even when the ratio of the amount of wax contained in the clear toner to the amount of wax contained in the color toners varies, the font size and the font line width with which the gloss produced by the gloss treatment cannot be visually recognized, varies little. However, when the ratio of the amount of wax contained in the clear toner to the amount of wax contained in the color toners exceeds 25%, for example, in a case where the amount of wax contained in the clear toner is greater than 0.25 times the amount of wax contained in the color toners, in accordance with an increase of the ratio of the amount of wax contained in the clear toner to the amount of wax contained in the color toners, font sizes and font line widths with which gloss produced by the gloss treatment cannot be visually recognized, increases significantly.

In addition, the gloss treatment was carried out on the paper P with the gloss treatment device after forming color toner images and a clear toner image on the entirety of a printing region of the paper P. In the gloss treatment device, a conveying speed of the conveying belt is set to 60 mm/sec, and a heating temperature of the heating roller is set to 130° C. In addition, a relationship between the ratio of the amount of wax contained in the clear toner to the amount of wax contained in the color toners, and an area of a poor gloss region was examined. The results are shown in FIG. 7.

Figure 7:
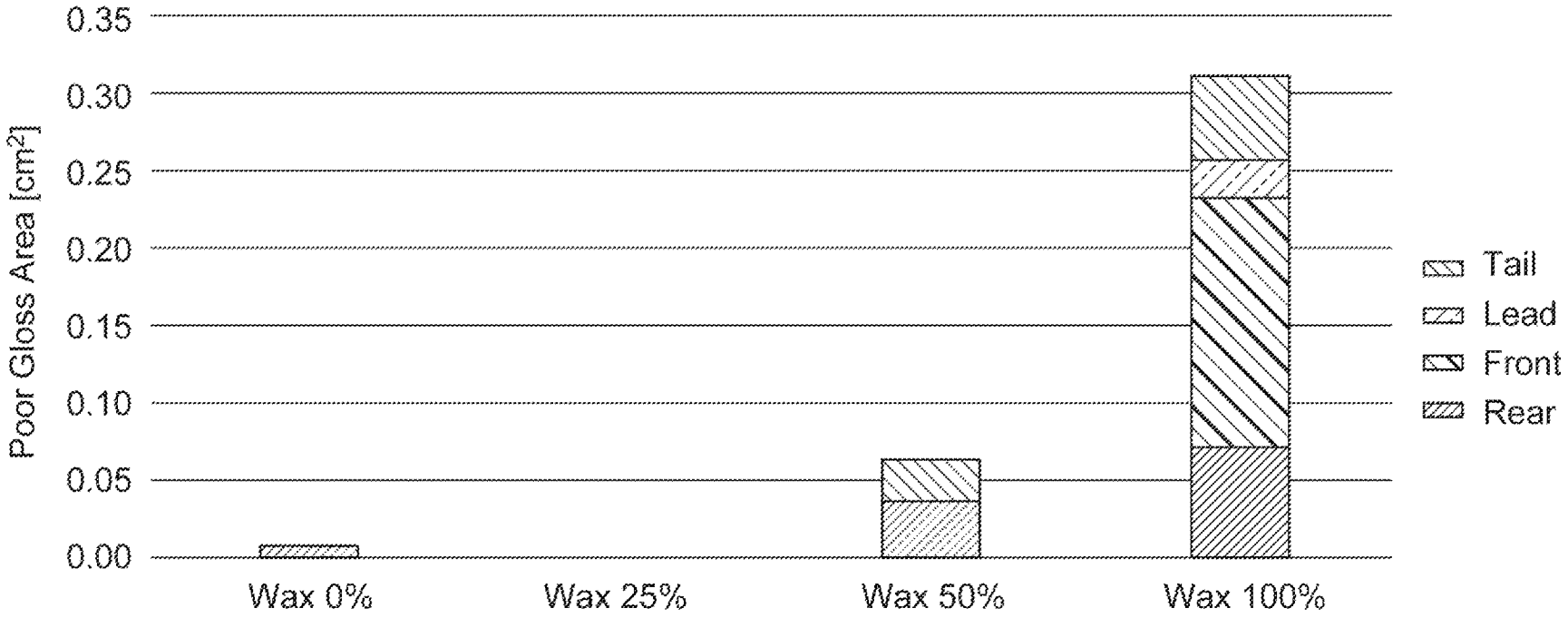
FIG. 7 is a graph showing an example relationship of a wax content and an amount of poor gloss area.

FIG. 7 shows a relationship of the ratio of the amount of wax contained in the clear toner to the amount of wax contained in the color toners, and the area of a poor gloss region. In FIG. 7, the horizontal axis represents the ratio [%] of the amount of wax contained in the clear toner to the amount of wax contained in the color toners, and the vertical axis represents the area [$cm^2$] of the poor gloss region. The poor gloss region is a region of the printing region in which gloss cannot be visually recognized. A poor gloss region may occur in irregular shapes along the four sides or edge portions of the sheet of paper P, and a total area of the poor gloss regions were calculated, and the total area is set as an area of the poor gloss region. In FIG. 7, Tail indicates an area of poor gloss region along a rear edge portion of the paper P in the conveying direction, Lead indicates an area of poor gloss region along a front edge portion of the paper P in the conveying direction, Front indicates an area of poor gloss region along a right-side edge portion of the paper P, and Rear indicates an area of poor gloss region along a left-side portion of the paper P. The areas of the poor gloss regions of Tail, Lead, Front and Rear portions are represented separately in the graph of FIG. 7.

As shown in FIG. 7, when the ratio of the amount of wax contained in the clear toner to the amount of wax contained in the color toners is 25% or less, for example, in a case where the amount of wax contained in the clear toner is 0.25 times or less the amount of wax contained in the color toners, even when the ratio of the amount of wax contained in the clear toner to the amount of wax contained in the color toners varies, an area of a poor printing region varies little. When the ratio of the amount of wax contained in the clear toner to the amount of wax contained in the color toners exceeds 25%, for example, when the amount of wax contained in the clear toner is greater than 0.25 times the amount of wax contained in the color toners, the area of the poor gloss region significantly increases with an increase of the ratio of the amount of wax contained in the clear toner to the amount of wax contained in the color toners.

The amount of wax contained in the clear toner may be less than the amount of wax contained in the color toner. For example, the amount of wax contained in the clear toner may be 0.25 times or less the amount of wax contained in the color toners from the viewpoint of the above-described result. According to some examples, the clear toner may contain no wax or may be substantially free wax (e.g., contains a negligible amount of wax) in order to increase the gloss of the image formed from the clear toner.

As described above, in the image forming apparatus 1A illustrated in FIG. 1, the amount of wax contained in the clear toner is less than the amount of wax contained in the color toners. Accordingly, when the paper P is subjected to the gloss treatment by the gloss treatment device 70, the paper P is in close contact with the surface of the conveying belt 71 for a longer time (duration) in the region in which the clear toner image is formed (e.g., clear toner image region), in comparison to the region in which the color toner images are formed excluding any clear toner image region (e.g., color-exclusive image region) so as to increase glossiness in the clear toner image region. In the region in which the color toner images are formed, the paper P is peeled-off from the conveying belt 71 earlier in comparison to the exclusive region in which the clear toner image is formed (without any color toner image), and thus the glossiness decreases.

A time (duration) during which the paper P is in close contact with the conveying belt 71 varies also due to the degree of melting of the toner. For example, in a case where the toner is sufficiently melted, the time during which the paper P is in close contact with the conveying belt 71 increases in comparison to a case where the toner is not sufficiently melted or the toner is not melted. In addition, the degree of melting of the toner increases as the melting temperature of the toner is lower. The melting temperature of the toner is a temperature at which melting of the toner is initiated, and may be referred to as a melting point. Accordingly, the melting temperature of the clear toner may be lower than a melting temperature of the color toners. For example, the melting temperature of the toner varies in accordance with the kind of a resin contained in the toner. Accordingly, the resin contained in the clear toner may be set to a resin of which a melting point is lower than that of a resin contained in the color toners.

Figure 8:
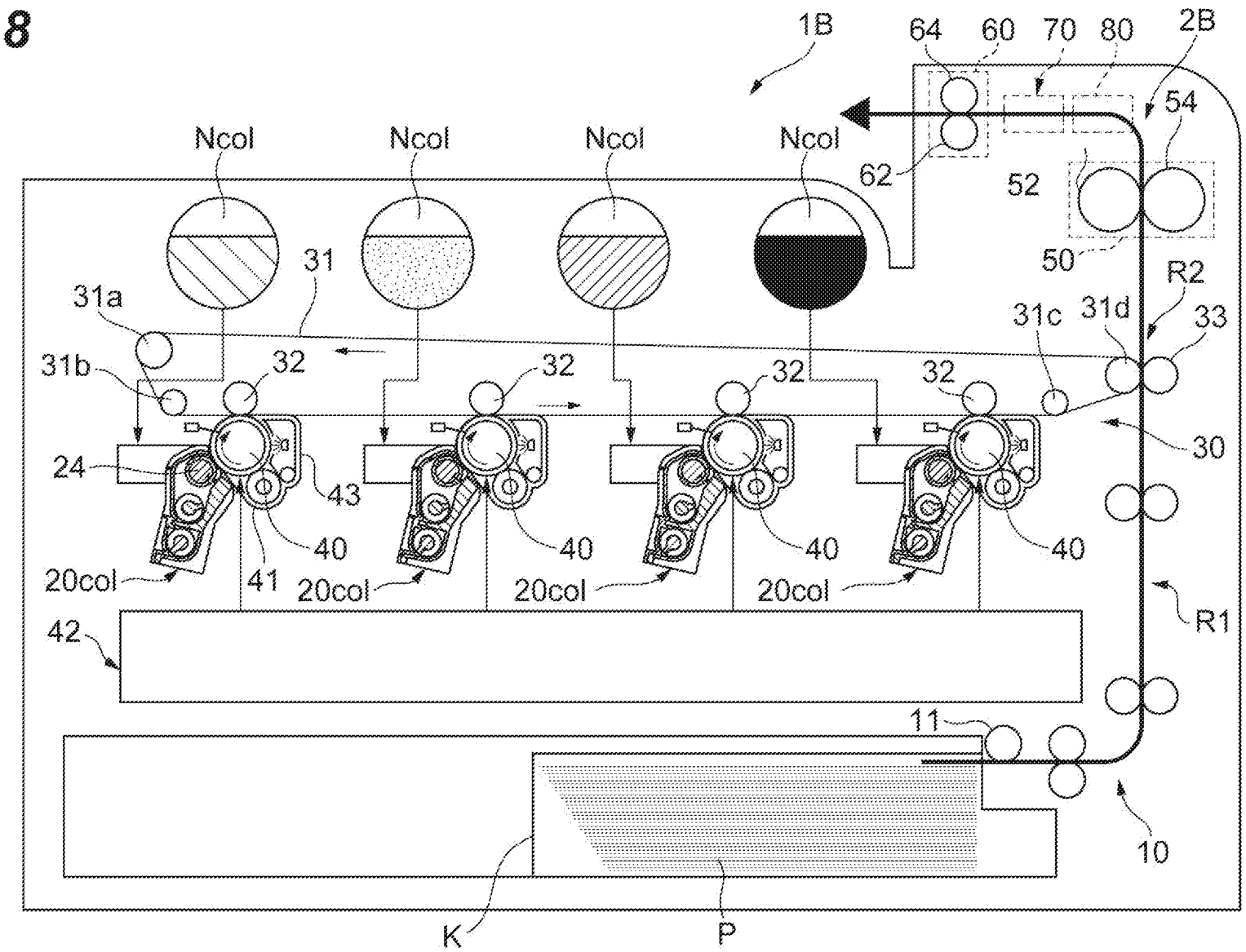
FIG. 8 is a schematic view illustrating an example image forming apparatus.

FIG. 8 is a schematic view illustrating another example image forming apparatus. An image forming apparatus 1B illustrated in FIG. 8 includes a toner image forming device 2B and a gloss treatment device 70. The toner image forming device 2B may form a color toner image with a color toner such as magenta, yellow, cyan, and black, and a clear toner image with a clear toner for applying gloss on a printing medium such as paper P. The gloss treatment device 70 may apply gloss treatment to the paper P on which the color toner images and the clear toner image are formed. The color toners and the clear toner may be similar to the color toners and the clear toner in the image forming apparatus 1A illustrated in FIG. 1. In addition, the amount of wax contained in the color toners and the clear toner may be similar to the amount of wax contained in the color toners and the clear toner in the image forming apparatus 1A illustrated in FIG. 1.

The toner image forming device 2B is similar to the toner image forming device 2A of the image forming apparatus 1A illustrated in FIG. 1, with some exceptions. For example, the toner image forming device 2B includes a clear toner transfer device 80 to form the clear toner image on the paper P. The clear toner transfer device 80 is a second transfer device.

The toner image forming device 2B includes a conveying device 10 that conveys the paper P, a color toner development device 20*col* that is a first development device that develops an electrostatic latent image for a color toner, a transfer device 30 as a first transfer device that secondarily transfers the color toner image to the paper P, an image carrier 40 in which an electrostatic latent image is formed on a surface (peripheral surface), a fixing device 50 that fixes the color toner image to the paper P, an ejection device 60 that ejects the paper P, and a clear toner transfer device 80 that transfers a clear toner image of a clear toner to the paper P to which the color toner image is fixed.

Four of the color toner development devices 20*col* are provided in correspondence with the color toners. Four of the image carriers 40 are provided in correspondence with the color toners. The image carriers 40 are spaced apart along a movement direction of the transfer belt 31. For each of the image carriers 40, one of the color toner development devices 20*col*, a charging roller 41, an exposure unit (or exposure device) 42, and a cleaning unit (or cleaning device) 43 are provided around the image carriers 40. The transfer device 30 secondarily transfers a color toner image formed on each of the color toner development devices 20*col* to the paper P. The fixing device 50 conveys the paper P to pass through a fixing nip region in which the paper P is heated and pressed, thereby attaching to the paper P the color toner image, which has been secondarily transferred from the transfer belt 31 to the paper P, and fixing the color toner image.

Figure 9:
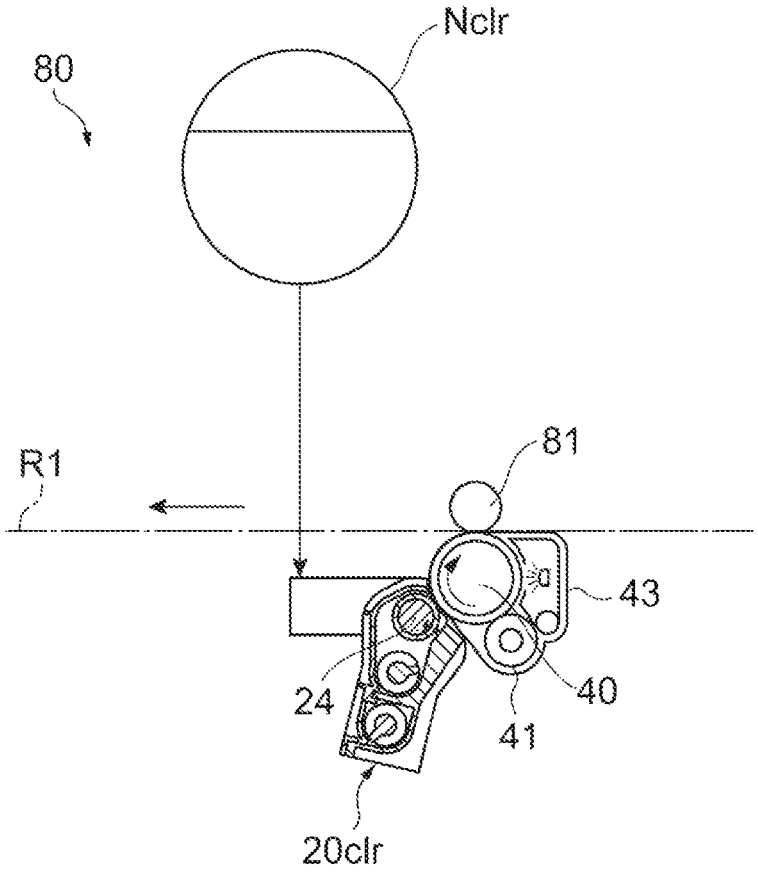
FIG. 9 is a schematic view illustrating an example clear toner transfer device.

FIG. 9 is a schematic view illustrating the example clear toner transfer device. The example clear toner transfer device 80 transfers a clear toner image to the paper P to which the color toner image is fixed. The clear toner transfer device 80 is disposed between the fixing device 50 and the gloss treatment device 70 in the conveying direction of the paper P.

The clear toner transfer device 80 includes a clear toner development device 20*clr* that is a second development device that develops an electrostatic latent image for a clear toner, an image carrier 40 having a surface (peripheral surface) on which the electrostatic latent image is formed, and a transfer roller 81 that transfers the clear toner image to the paper P.

One of the clear toner development device 20*clr* is provided in correspondence with the clear toner. One of the image carrier 40 is provided in correspondence with the clear toner. The image carrier 40 is provided on a conveying route of the paper P. The clear toner development device 20*clr*, the charging roller 41, the exposure unit 42, and the cleaning unit 43 are provided adjacent (e.g., around the periphery of) the image carrier 40. The transfer roller 81 comes into press contact with the image carrier 40 with the conveying route R1 of the paper P interposed therebetween, and transfers the clear toner image from the image carrier 40 to the paper P.

A printing process carried out by the image forming apparatus 1B will be described. When an image signal of an image to be recorded (on a recording medium) is input to the image forming apparatus 1B, a control unit (or controller) of the image forming apparatus 1B causes the paper feeding roller 11 to rotate so as to pick up and convey the paper P stacked in the cassette K. In addition, the surface of the image carrier 40 is uniformly charged to a predetermined potential by the charging roller 41 (charging process). The exposure device 42 irradiates the surface of the image carrier 40 with laser light based on the image signal that is received, to form an electrostatic latent image (exposure process).

In each of the color toner development devices 20*col*, an electrostatic latent image is developed so as to form a color toner image (development process). The color toner image formed in this manner is primarily transferred from the image carrier 40 to the transfer belt 31 in a region in which the image carrier 40 and the transfer belt 31 face each other (transfer process). The color toner images formed on the four the image carriers 40 are sequentially layered on the transfer belt 31, and a single composite color toner image is formed. In addition, the layered color toner image is secondarily transferred to the paper P that is conveyed from the conveying device 10 in the transfer nip region R2 where the suspension roller 31*d* and the secondary transfer roller 33 face each other.

The paper P to which the composite color toner image is secondarily transferred, is conveyed to the fixing device 50.

The fixing device 50 heats and presses the paper P between the heating roller 52 and the pressing roller 54 when the paper P passes through the fixing nip region to melt and fix the composite color toner image to the paper P (fixing process).

The paper P to which the composite color toner image is fixed is conveyed to the clear toner transfer device 80. In the clear toner development device 20*clr* of the clear toner transfer device 80, the electrostatic latent image is developed, to form a clear toner image (development process). The clear toner image that is formed in this manner is transferred to the paper P to which the composite color toner image has been fixed, in a transfer nip region in which the image carrier 40 and the transfer roller 81 face each other (transfer process).

The paper P to which the clear toner image has been transferred is conveyed to the gloss treatment device 70. In the gloss treatment device 70, the paper P passes through the re-melting nip region R4 between the heating roller 73 and the pressing roller 74, so as to heat and press the paper P. Accordingly, the color toners and the clear toner which constitute the color toner images and the clear toner image formed on the paper P are re-melted in a pressed state (re-melting process). In the re-melting process, the toners are re-melted, and thus the toners on the paper P come into close contact with a surface of the conveying belt 71. In addition, the cooling device 75 cools down the conveying belt 71 and the paper P, and thus the melted toners are cooled and solidified (cooling process). As the melted toners are cooled and solidified by the cooling process, a surface shape of the conveying belt 71 is transferred to the toner on a surface of the paper P, in order to flatten (or smoothen) the melted toner. The toners on the paper P are peeled-off from the surface of the conveying belt 71, and the paper P is ejected to the outside of the image forming apparatus 1B by the ejection rollers 62 and 64.

The clear toner image is transferred to the paper P after the color toner images are fixed to promote the peeling-off of the paper P from the transfer belt 31, even when the amount of wax contained in the clear toner is less than the amount of wax contained in the color toners.

Figure 10:
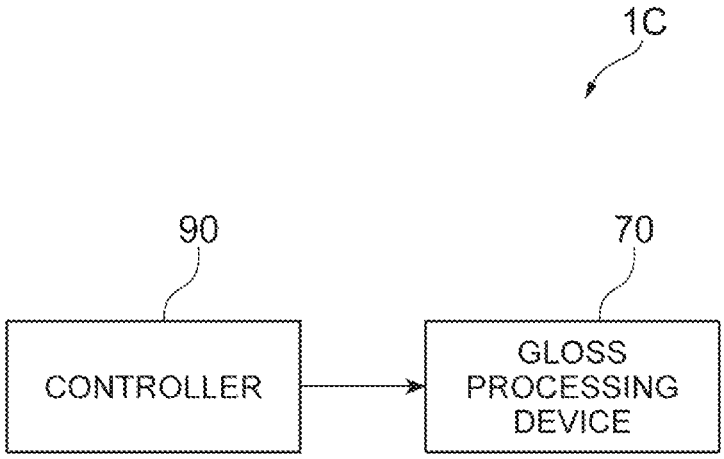
FIG. 10 is a block diagram illustrating components of an example image forming device.

FIG. 10 is a conceptual diagram illustrating a part of an example image forming apparatus 1C. The image forming apparatus 1C illustrated in FIG. 10 includes a control unit (or controller) 90 that controls the gloss treatment device 70.

In a first case, according to a first operational mode of the gloss treatment device 70, the printing region of the paper P includes both an image composed of the color toners exclusively without any clear toner, and an image formed from the clear toner. In this first case, the controller 90 controls the gloss treatment device 70 so that a time or duration during which the paper P is in close contact with the conveying belt 71 is shorter in comparison to a second case, according to a second operational mode of the gloss treatment device 70, where the clear toner image is formed in the entire printing region of the paper P. Accordingly, in the first case described above, the controller 90 controls the gloss treatment device 70 so that the toner heating time is shorter in comparison to the second case described above. Determination as to whether the clear toner image is formed in a part of the printing region of the paper P or whether the clear toner image is formed in the entirety of the printing region may be determined, for example, based on a printing instruction operation (or command) received from an operator via an operation panel or the like, an analysis result of image signals for performing printing, or the like.

A clear toner region (or clear toner image region) in which the clear toner image is formed and a color-exclusive image region in which the color toner images are formed exclusively (without any clear toner image) may be provided in the paper P. It may be intended that the gloss (or glossiness) of the clear toner image region be greater than and the gloss of the color-exclusive image region. In some examples, the clear toner image region may be intended to be glossy, while the color-exclusive image region may be intended not to be glossy. In this case, the heating time in the re-melting nip region R4 may be relatively long, such that the toners are sufficiently re-melted even in the color-exclusive image regions, to increase an adhesive force with the conveying belt 71, such that the difference in gloss between the clear toner image region and the color-exclusive image region is reduced or less apparent to the naked eye. Accordingly, a gloss difference may be less likely to occur between the clear toner image region and the color toner region.

Figure 11:
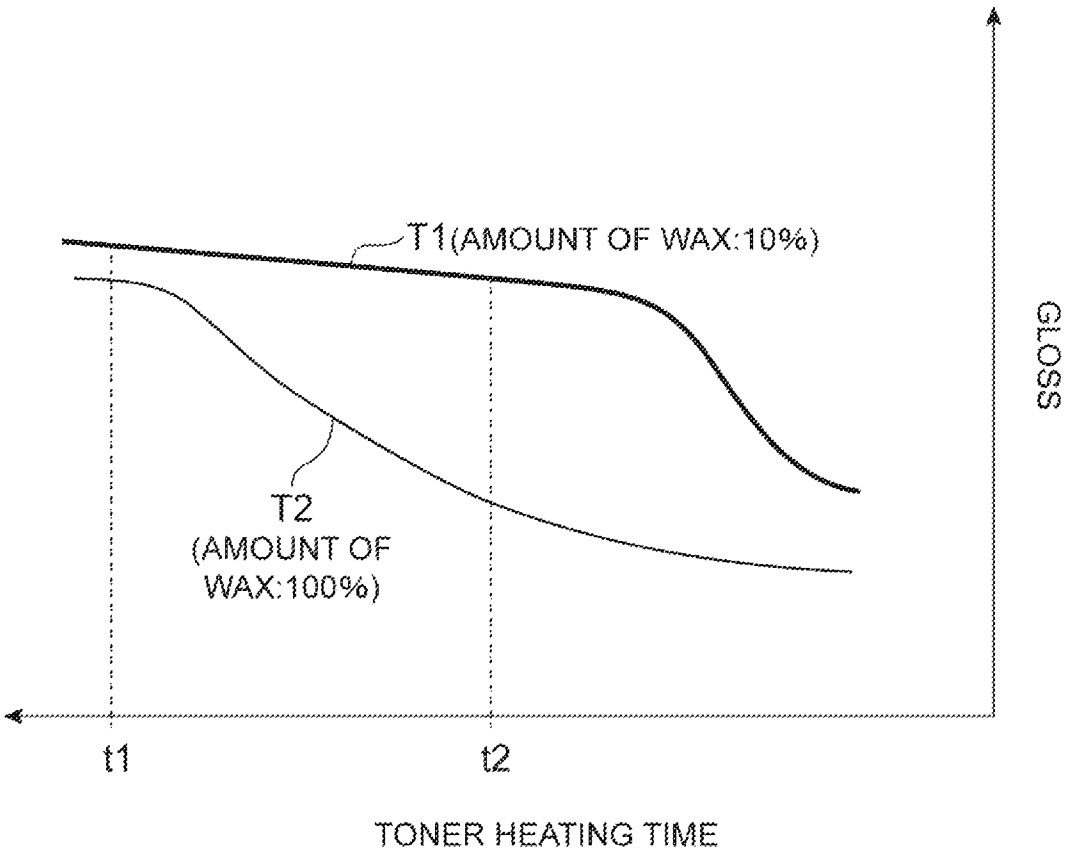
FIG. 11 is a graph showing an example relationship of a toner heating time relative to an amount of toner gloss.

FIG. 11 shows a relationship between a toner heating time and an amount of toner gloss. In FIG. 11, the horizontal axis represents the toner heating time and the vertical axis represents the toner gloss. A graph line T1 represents paper P on which a toner image is formed with a first toner (having an amount of wax of: 10%), and a graph line T2 represents paper P on which a toner image is formed with a second toner (having an amount of wax of: 100%). The percentage of wax is relative to the amount of wax in the second toner. For example, the amount of wax represents a value obtained by converting the amount of wax contained in the second toner as 100%.

FIG. 11 illustrates a case where the printing region of the paper P includes both an image composed of the color toners (second toners) exclusively (without any clear toner) and an image in which the clear toner (first toner) is formed on an uppermost layer. In this case, at a heating time t1 in the graph of FIG. 11, all toners are sufficiently melted, such that the gloss of the images increases and there is almost no difference in gloss between the first toner image and the second toner images. However, at a heating time t2, a duration of close contact with the conveying belt 71 becomes relatively shorter for the color toners in which the amount of wax is greater, in comparison to the clear toner in which the amount of wax is less, so as to increase the difference in gloss between the color toners and the clear toner.

As described above, the time for which the paper P is in close contact with the conveying belt 71 varies in accordance with the toner heating time. Accordingly, when the toner heating time (or duration) is reduced, the time (or duration) during which the paper P is in close contact with the conveying belt 71 is also reduced. In addition, the toner heating time varies in accordance with a conveying speed of the paper P by the conveying belt 71, a length of the re-melting nip region R4 in the conveying direction of the paper P, or the like. For example, when the conveying speed of the paper P by the conveying belt 71 is increased, the toner heating time decreases. In addition, when the length of the re-melting nip region R4 in the conveying direction of the paper P is shortened, the toner heating time or duration is reduced.

Figure 12:
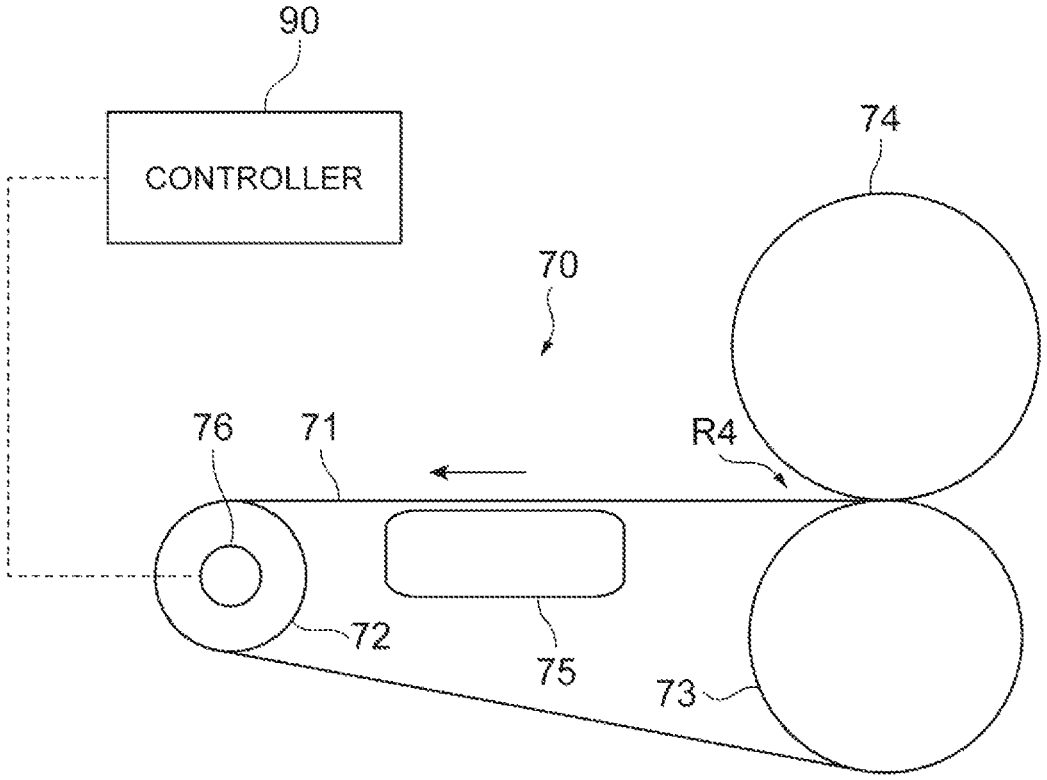
FIG. 12 is a schematic diagram illustrating an example gloss treatment device and a controller.

In some examples, with reference to FIG. 12, the controller 90 may control the conveying speed of the paper P in the gloss treatment device 70. In a first case where the clear toner image is formed in a part of the printing region of the paper P, the controller 90 may set the conveying speed of the paper P by the conveying belt 71 to be higher in comparison to a second case where the clear toner image is formed in the entirety of the printing region of the paper P. The conveying speed of the paper P can be controlled by controlling a rotation speed of a motor 76 that rotates the suspension roller 72.

Figure 13:
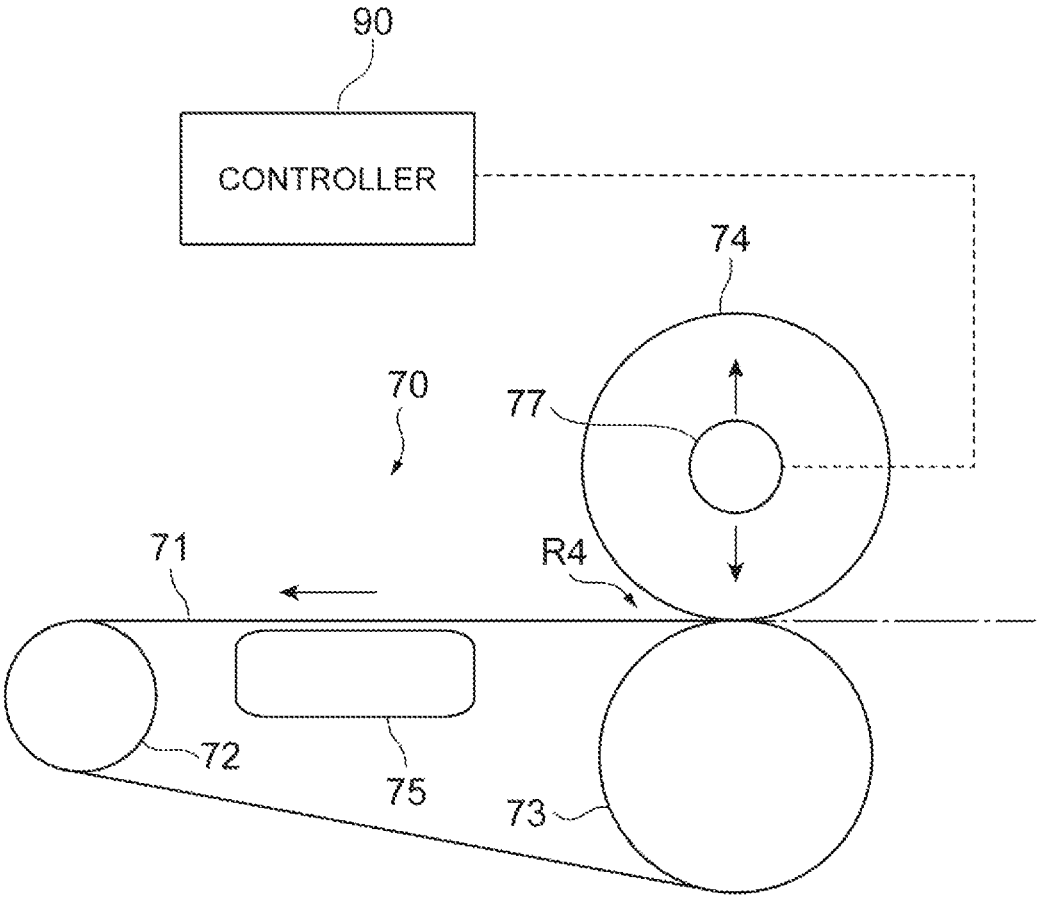
FIG. 13 is a schematic diagram illustrating an example gloss treatment device and a controller.

According to examples, with reference to FIG. 13, the controller 90 may control a width of the re-melting nip region R4 in the conveying direction of the paper P in the gloss treatment device 70. In a first case where the clear toner image is formed in a part of the printing region of the paper P, the controller 90 may set the width of the re-melting nip region R4 in the conveying direction of the paper P to be narrower in comparison to a second case where the clear toner image is formed at the entirety of the printing region of the paper P. In some examples, the width (or distance, or length) of the re-melting nip region R4 in the conveying direction of the paper P can be varied by varying a pressing force of the pressing roller 74 against the heating roller 73. That is, by increasing the pressing force of the pressing roller 74 against the heating roller 73, the width of the re-melting nip region R4 in the conveying direction of the paper P is widened, and by decreasing the pressing force of the pressing roller 74 against the heating roller 73, the width of the re-melting nip region R4 in the conveying direction of the paper P is narrowed. According to examples, the width of the re-melting nip region R4 can be varied by controlling an operation of an actuator 77 that moves the pressing roller 74 in a separation and contact direction with respect to the heating roller 73. For example, the actuator 77 moves the pressing roller 74 toward and away from the heating roller 73.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

For example, although the clear toner transfer device 80 that is the second transfer device of the image forming apparatus 1B illustrated in FIG. 8 has been described to be constituted by a device configured to form the clear toner image on the paper P in the image forming apparatus 1A illustrated in FIG. 1, according to examples, the second transfer device may be a different device having a different configuration that transfers a clear toner image to paper to which a color toner image is fixed. For example, the second transfer device may include a housing (clear toner tank) that accommodates the clear toner, and a clear toner transfer roller that is disposed on a paper conveying route or in the vicinity of the paper conveying route, so that the clear toner transfer roller may pick up the clear toner accommodated in the housing to transfer the clear toner to the paper.

The invention claimed is:

1. An imaging system comprising:

a toner image forming device to accommodate a color toner to form a color toner image on a printing medium, and to accommodate a clear toner having a wax content that is lower than a wax content of the color toner, the clear toner to form a clear toner image on the printing medium; and a gloss treatment device to melt the clear toner on the printing medium in order to apply a gloss treatment to the printing medium that includes the color toner image and the clear toner image.

2. The imaging system according to claim 1, wherein the toner image forming device includes, a first development device to develop the color toner image, a second development device to develop the clear toner image, a transfer device to transfer the color toner image and the clear toner image to the printing medium, and a fixing device to fix the color toner image and the clear toner image to the printing medium.

3. The imaging system according to claim 1, wherein the toner image forming device includes, a first development device to develop the color toner image, a first transfer device to transfer the color toner image to the printing medium, a fixing device to fix the color toner image to the printing medium, a second development device to develop the clear toner image, and a second transfer device to transfer the clear toner image to the printing medium which includes the color toner image having been fixed.

4. The imaging system according to claim 1, wherein the wax content of the clear toner is 0.25 times or less the wax content of the color toner.

5. The imaging system according to claim 1, wherein the clear toner is substantially free of wax.

6. The imaging system according to claim 1, wherein the clear toner includes a semi-transparent toner such that the clear toner image formed on the printing medium is semi-transparent.

7. The imaging system according to claim 1, wherein the gloss treatment device includes, a conveying belt to convey the printing medium including the color toner image and the clear toner image, a re-melting device that is disposed along the conveying belt to re-melt the color toner and the clear toner, and a cooling device to solidify the color toner and the clear toner having melted.

8. The imaging system according to claim 7, wherein the color toner image includes a color-exclusive toner image composed of the color toner excluding any of the clear toner, the gloss treatment device to operate in a first operational mode in which a printing region of the printing medium includes a color-exclusive toner image and the clear toner image, and to operate in a second operational mode in which the clear toner image is formed in the entirety of the printing region of the printing medium, and wherein the imaging system comprises a controller to control the gloss treatment device so that the printing medium is in surface contact with the conveying belt for a first duration in the first operational mode, and for a second duration that is longer than the first duration, in the second operational mode.

9. The imaging system according to claim 7, the gloss treatment device to operate in a first operational mode in which the clear toner image is formed in part of a printing region of the printing medium and in a second operational mode in which the clear toner image is formed in an entirety of the printing region of the printing medium, wherein the imaging system comprises a controller to control a conveying speed of the printing medium, to be higher in the first operational mode than in the second operational mode.

10. The imaging system according to claim 7, the gloss treatment device to operate in a first operational mode in which the clear toner image is formed in part of a printing region of the printing medium and in a second operational mode in which the clear toner image is formed in an entirety of the printing region of the printing medium, wherein the re-melting device of the gloss treatment device forms a re-melting nip region between the re-melting device and the conveying belt to re-melt the color toner and the clear toner on the printing medium, wherein the imaging system comprises a controller to set a length of the re-melting nip region in a conveying direction of the printing medium to be shorter in the first operational mode than in the second operational mode.

11. The imaging system according to claim 10, wherein the re-melting device includes a heating roller, and a pressing roller to press the conveying belt against the heating roller and to form the re-melting nip region between the pressing roller and the conveying belt, and the controller to control the length of the re-melting nip region in the conveying direction of the printing medium by controlling a pressing force of the pressing roller against the heating roller.

12. The imaging system according to claim 1, gloss treatment device to melt the clear toner at a first melting temperature and to melt the color toner at a second melting temperature that is greater than the first melting temperature.

13. An imaging system comprising:

a toner image forming device that includes a first toner tank accommodating a color toner to form a color toner image, and a second toner tank accommodating a clear toner having a wax content that is lower than a wax content of the color toner, the clear toner to form a clear toner image on a printing medium; and a gloss treatment device to melt the color toner and the clear toner on the printing medium in order to apply a gloss treatment to the printing medium that includes the color toner image and the clear toner image.

14. The imaging system according to claim 13, wherein an amount of wax contained in the clear toner is 0.25 times or less the amount of wax contained in the color toner.

15. The imaging system according to claim 13, wherein the color toner image includes a color-exclusive toner image composed of the color toner excluding any of the clear toner, the gloss treatment device to operate in a first operational mode in which a printing region of the printing medium includes both the color-exclusive toner image and the clear toner image, and to operate in a second operational mode in which the clear toner image is formed in the entirety of the printing region of the printing medium, and wherein the imaging system comprises a controller to control the gloss treatment device to heat the color toner and the clear toner for a first heating duration in the first operational mode, and for a second heating duration in the second operational mode, wherein the first heating duration is shorter than the second heating duration.

* * * * *